United States Patent [19]

Ambroszewski

[11] Patent Number: 4,632,006

[45] Date of Patent: Dec. 30, 1986

[54] REMOVABLE DRUMSTICK MALLET HEAD

[76] Inventor: Michael Ambroszewski, 41 Autumn St., E. Rochester, N.H. 03867

[21] Appl. No.: 712,550

[22] Filed: Mar. 15, 1985

[51] Int. Cl.[4] ..... G10D 13/02

[52] U.S. Cl. ..... 84/422 S

[58] Field of Search ..... 84/422 R, 422 S

[56] References Cited

U.S. PATENT DOCUMENTS

| | | | |
|---|---|---|---|
| 1,277,123 | 8/1918 | Riches | 84/422 C |
| 1,892,886 | 1/1933 | Haight | 84/422 S |
| 1,953,619 | 4/1934 | Ludwig | 84/422 S |
| 2,586,163 | 2/1952 | Heiderich et al. | 84/422 S |
| 3,998,123 | 12/1976 | Hinger | 84/422 S |
| 4,202,241 | 5/1980 | Lucas | 84/422 S |

*Primary Examiner*—Lawrence R. Franklin

*Attorney, Agent, or Firm*—Lee A. Strimbeck

[57] ABSTRACT

A removable drumstick mallet head comprises (1) a hollow rubber core the bore of which is sized to fit over the end of a drumstick, and (2) a cover, preferably of felt, drawn down tightly over the core.

5 Claims, 4 Drawing Figures

REMOVABLE DRUMSTICK MALLET HEAD

This invention is an article of manufacture —a felt surfaced mallet head that slips onto the butt of a drumstick converting the stick into a combination stick. The drumstick with the mallet head in place may be flipped over and used as a soft mallet on for example tom toms, cymbals and timpani. The mallet head of this invention stays on the drumstick without the use of adhesives and may be put on and taken off at any time.

In brief compass this invention is a finger removable drumstick mallet head comprising a hollow rubber core sized to slip onto the butt end of a drumstick and resiliently engage the drum stick, and a cover of a sheet material drawn tightly over the core. The sheet material will usually be a graded piano felt cut from a flat sheet but can also be for example a woven cloth cover or a sheared sheepskin or a firm blown elastomer sheet such as of a polyurethane.

The resilient core is preferably in the shape of a truncated cone of an elastomer having a central cylindrical bore with the top of the truncated cone being positioned against the inner central portion of the cover. As the core is resilient, only one or two sizes of central bores are required to fit over most drumsticks, e.g. two sizes, one with a ⅜ inch inner diameter and one with a 9/16 inch inner diameter, will fit the butt end of most drumsticks commonly used. As the core is stretched a fair amount on being placed on the drumstick it grips the drumstick quite firmly and will not come off until slipped or worked off by hand.

Combination sticks with a fixed mallet head at one end have been commercially available in the past but they come in a very limited variety, sizes, styles and brands. The present invention permits a great deal of versatility as the mallet head does not come attached to a stick. The present invention can be stretched over the end of any size, style and brand of drumstick but is not a permanent attachment since it does not require adhesive and can be put on or taken off at any time. The present invention eliminates the need of having to buy combination sticks and allows a player his preference of the many different drumsticks on the market today.

THE DRAWINGS

In the drawings

Like parts have the same number in all of the figures.

DESCRIPTION

Figure 1:
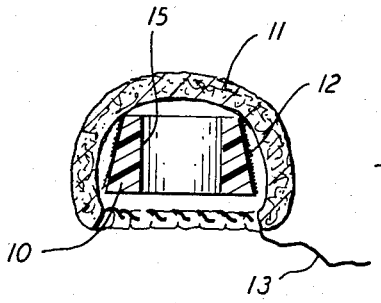
FIG. 1 is a cross-sectional view of the mallet head of this invention, with the outer cover in place but prior to it being tightly drawn around the core.

In the drawings, an elastomeric core is shown at 10. It has a cylindrical bore 15. A covering, in this case a piano felt covering, is shown at 11, a contact adhesive is shown at 12, placed on the outer surface of the core, and a drawstring is shown at 13. The butt end of a drumstick is shown at 14.

The mallet head of this invention is manufactured by taking a truncated cone of a rubber or suitable elastomer 10 which has a central bore 15 sized to fit tightly over the drum stick 14. Usually the bore diameter will be either ⅜ inch or 9/16 inch to fit most standard drumsticks. The core with a ⅜ inch bore can have, for example, a height of ⅜ inch and a base diameter of ¾ inch. The core may have other shapes such as spherical or partly spherical, it being sufficient that when the outer cover is placed on the core, the mallet head have the generally spherical or mushroom cap shape desired.

The core's outer surface can be coated with a flexible contact adhesive 12 to more firmly secure the cover to the core. The inner surface of the cover can also be coated. The use of an adhesive is optional but preferred.

Figure 3:
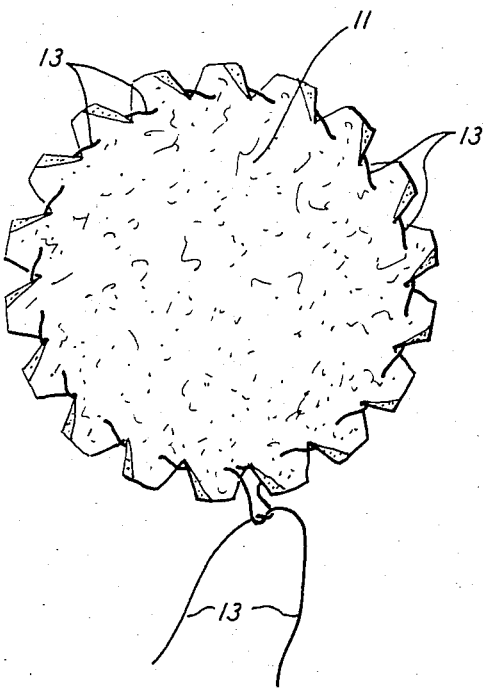
FIG. 3 is a top view of a felt cover cut from flat stock prior to being placed over the core.
Figure 4:
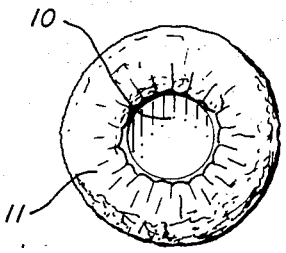
FIG. 4 is a bottom perspective view of a mallet head.

In the preferred embodiment of the invention, the outer cover 11 consists of a graded piano felt of the firmness desired. These felts are available commercially. As shown in FIG. 3, the cover is cut from flat stock, e.g. one about 3/16 inch thick, with a scalloped or serrated edge to assist in the drawing down of the cover over the core. The scalloped edge is threaded with a drawstring 13 and placed over the core as shown in FIG. 1, prior to being drawn over the core.

In some cases, the cover can be made with chopped fibers adhered to the core by an adhesive, instead of using a sheet material.

When the cover is in place as shown in FIG. 1, the drawstrings 13 are drawn up very tightly and tied. To avoid cutting off at the knot, the ends are threaded under the felt a short distance and then cut off so that they essentially do not show. The draw down is sufficient to tightly and smoothly conform the felt to the core and give the partially spherical mallet head shape desired. This method of drawing down the felt has previously been used to make timpani mallets whereby felt is drawn over a woodshaft with an enlarged permanently attached wood end.

Figure 2:
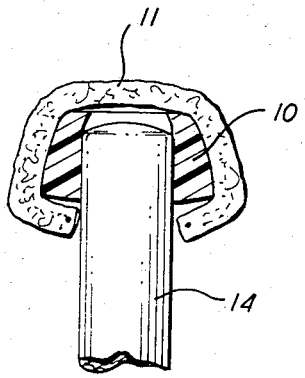
FIG. 2 is a cross-sectional view of the mallet head placed on to the butt end of a drumstick.

The thus manufactured mallet head is ready to be placed on the end of a drumstick as shown in FIG. 2. The mallet head is held with a fore finger and middle finger on the top and a thumb on the underside without covering the opening. The drumstick is inserted at an angle while applying firm pressure to the top of the mallet head and slowly straightening out the stick, stretching the core 10 over the end of the drumstick 14. The thumb, fore and middle fingers may then push the mallet head completely down onto the stick, rotating the stick between each push to make sure the mallet head is on evenly. The mallet head may be removed at any time by gripping it in the palm of the hand and twisting it off.

I claim:

1. A combination drumstick comprising a drumstick having an enlarged handle end and a smaller end for hitting a drum, and a finger removable mallet head on said handle end comprising a hollow rubber truncated rubber cone resiliently engaging said handle end and a cover of a flexible soft sheet material drawn tightly over said rubber cone, the smaller top of said rubber cone being positioned against the inner central portion of said cover and said mallet head having a mushroom cap shape.

2. The combination drumstick of claim 1 wherein said cover is drawn down and about said rubber cone by means of a drawstring about the periphery thereof and said cover is a circle cut from a flat sheet of a felt.

3. The mallet head of claim 1 wherein said cover is of a graded felt drawn tightly over said cone and adhered thereto with a flexible cement, and said cone is of an elastomer shaped to yield said generally spherical shape in combination with said felt.

4. The mallet head of claim 1 wherein said cone and cover are adhered with a flexible cement.

5. The mallet head of claim 4 wherein said cover is a piano felt the edges of said circle of which are scalloped and receive said drawstring.

* * * * *